US011692295B2

(12) United States Patent
Leibman et al.

(10) Patent No.: US 11,692,295 B2
(45) Date of Patent: Jul. 4, 2023

(54) LAUNDRY APPLIANCE HAVING ONE OR MORE WIRELESSLY POWERED FEATURES

(71) Applicant: Haier US Appliance Solutions, Inc., Wilmington, DE (US)

(72) Inventors: Alexander B. Leibman, Prospect, KY (US); Venkata Chakradhar Rangu, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 188 days.

(21) Appl. No.: 16/951,477

(22) Filed: Nov. 18, 2020

(65) Prior Publication Data

US 2022/0154380 A1 May 19, 2022

(51) Int. Cl.

| | |
|---|---|
| ***D06F 34/08*** | (2020.01) |
| ***D06F 37/42*** | (2006.01) |
| ***D06F 39/14*** | (2006.01) |
| ***D06F 23/06*** | (2006.01) |
| ***D06F 39/02*** | (2006.01) |
| ***D06F 34/04*** | (2020.01) |
| *D06F 103/40* | (2020.01) |

(52) U.S. Cl.

CPC ..... *D06F 34/08* (2020.02); *D06F 23/06* (2013.01); *D06F 34/04* (2020.02); *D06F 37/42* (2013.01); *D06F 39/02* (2013.01); *D06F 39/14* (2013.01); *D06F 2103/40* (2020.02)

(58) Field of Classification Search

CPC ..... D06F 34/08; D06F 34/04; D06F 23/06; D06F 37/42; D06F 39/02; D06F 39/14; D06F 2103/40; D06F 34/05; D06F 34/10

See application file for complete search history.

(56) References Cited

U.S. PATENT DOCUMENTS

| | | | | |
|---|---|---|---|---|
| 5,795,052 | A * | 8/1998 | Choi | D06F 39/00 362/802 |
| 8,106,539 | B2 | 1/2012 | Schatz et al. | |
| 9,708,751 | B2 | 7/2017 | Bae et al. | |
| 10,392,740 | B2 | 8/2019 | Scernetski et al. | |
| 2006/0005997 | A1 * | 1/2006 | Kim | H01H 13/06 174/267 |
| 2011/0162224 | A1 | 7/2011 | Bae et al. | |

(Continued)

FOREIGN PATENT DOCUMENTS

| | | | |
|---|---|---|---|
| CN | 103166326 | A | 6/2013 |
| DE | 10319532 | B4 | 12/2017 |

(Continued)

*Primary Examiner* — Michael E Barr

*Assistant Examiner* — Samuel Robert Barker

(74) *Attorney, Agent, or Firm* — Dority & Manning, P.A.

(57) ABSTRACT

A laundry appliance may include a cabinet, a drum, a door, a transmitter power coil, a receiver power coil, and an electronic component. The drum may be mounted within the cabinet. The drum may define a space for the receipt of articles therein. The door may be movably mounted to the cabinet to selectively restrict access to the drum. The transmitter power coil may be mounted to the cabinet proximal to the door. The receiver power coil may be mounted to the door in selective electromagnetic communication with the transmitter power coil to receive an electromagnetic field therefrom. The electronic component may be in electrical communication with the receiver power coil to receive power therefrom.

20 Claims, 9 Drawing Sheets

(56) References Cited

U.S. PATENT DOCUMENTS

| | | | | |
|---|---|---|---|---|
| 2017/0338860 | A1 | 11/2017 | Zou et al. | |
| 2019/0345660 | A1 * | 11/2019 | Nam | D06F 39/022 |

FOREIGN PATENT DOCUMENTS

| | | | | |
|---|---|---|---|---|
| DE | 102018006154 | A1 | 2/2020 | |
| JP | 2001/033136 | A | 2/2001 | |
| WO | WO2013/087774 | A1 | 6/2013 | |
| WO | WO-2013087774 | A1 * | 6/2013 | F25D 23/02 |
| WO | WO2019/223849 | A1 | 11/2019 | |

* cited by examiner

LAUNDRY APPLIANCE HAVING ONE OR MORE WIRELESSLY POWERED FEATURES

FIELD OF THE INVENTION

The present subject matter relates generally to laundry appliances, such as dryer and washing machine appliances, and more particularly to a laundry appliance having one or more wirelessly powered features.

BACKGROUND OF THE INVENTION

Laundry appliances, such as dryer appliances and washing machine appliances, generally include a cabinet with a drum mounted therein. In some appliances, a motor rotates the drum (or a basket therein) during operation of the thereof (e.g., to tumble articles located within a chamber defined by the drum). A door is typically provided to selectively cover an opening that permits access to the chamber defined by the drum. The chamber defined by the drum, and the inside of such a cabinet generally, is hostile to electric devices or features. In particular, water or moisture makes it difficult to power or operate electric features. For at least these reasons, most appliances do not include any electronic features proximal to the door or chamber. It can often be expensive and difficult to assemble an appliance where power has to be directed through one or more electrical connections that are repeatedly exposed to liquid water or excessive moisture. These difficulties can be magnified in the context of laundry appliances, which often agitate large volumes or masses of clothes that can strike or disrupt any wired electrical connection.

In spite of the existing challenges, it may be useful to have one or more features near the door or chamber defined by the drum of a laundry appliance. As an example, it may be useful to have one or more lights for illumination or sanitization of articles within the drum. As an additional or alternative example, it may be useful to have an additive dispensing assembly for delivering certain additives affecting the smell or performance of fabrics for the articles within the drum.

As a result, it may be advantageous to provide a laundry appliance addressing one or more of the above issues. In particular, it would be advantageous to provide a laundry appliance having one or more electronic features to which power could be supplied to one or more areas without requiring a direct wired connection.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry appliance is provided. The laundry appliance may include a cabinet, a drum, a door, a transmitter power coil, a receiver power coil, and an electronic component. The drum may be mounted within the cabinet. The drum may define a space for the receipt of articles therein. The door may be movably mounted to the cabinet to selectively restrict access to the drum. The transmitter power coil may be mounted to the cabinet proximal to the door. The receiver power coil may be mounted to the door in selective electromagnetic communication with the transmitter power coil to receive an electromagnetic field therefrom. The electronic component may be in electrical communication with the receiver power coil to receive power therefrom.

In another exemplary aspect of the present disclosure, a laundry appliance is provided. The laundry appliance may include a cabinet, a drum, a door, a transmitter power coil, a door switch, a controller, a receiver power coil, and an electronic component. The drum may be mounted within the cabinet. The drum may define a space for the receipt of clothes therein. The door may be movably mounted to the cabinet to selectively restrict access to the drum in a closed position. The transmitter power coil may be mounted to the cabinet proximal to the door. The door switch may be mounted to the cabinet at the transmitter power coil. The controller may be mounted to the cabinet in electrical communication with the transmitter power coil and the door switch to detect the door in the closed position. The receiver power coil may be mounted to the door in selective electromagnetic communication with the transmitter power coil to receive an electromagnetic field therefrom. The electronic component may be in electrical communication with the receiver power coil to receive power therefrom. The electronic component may be electrically isolated from the controller.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
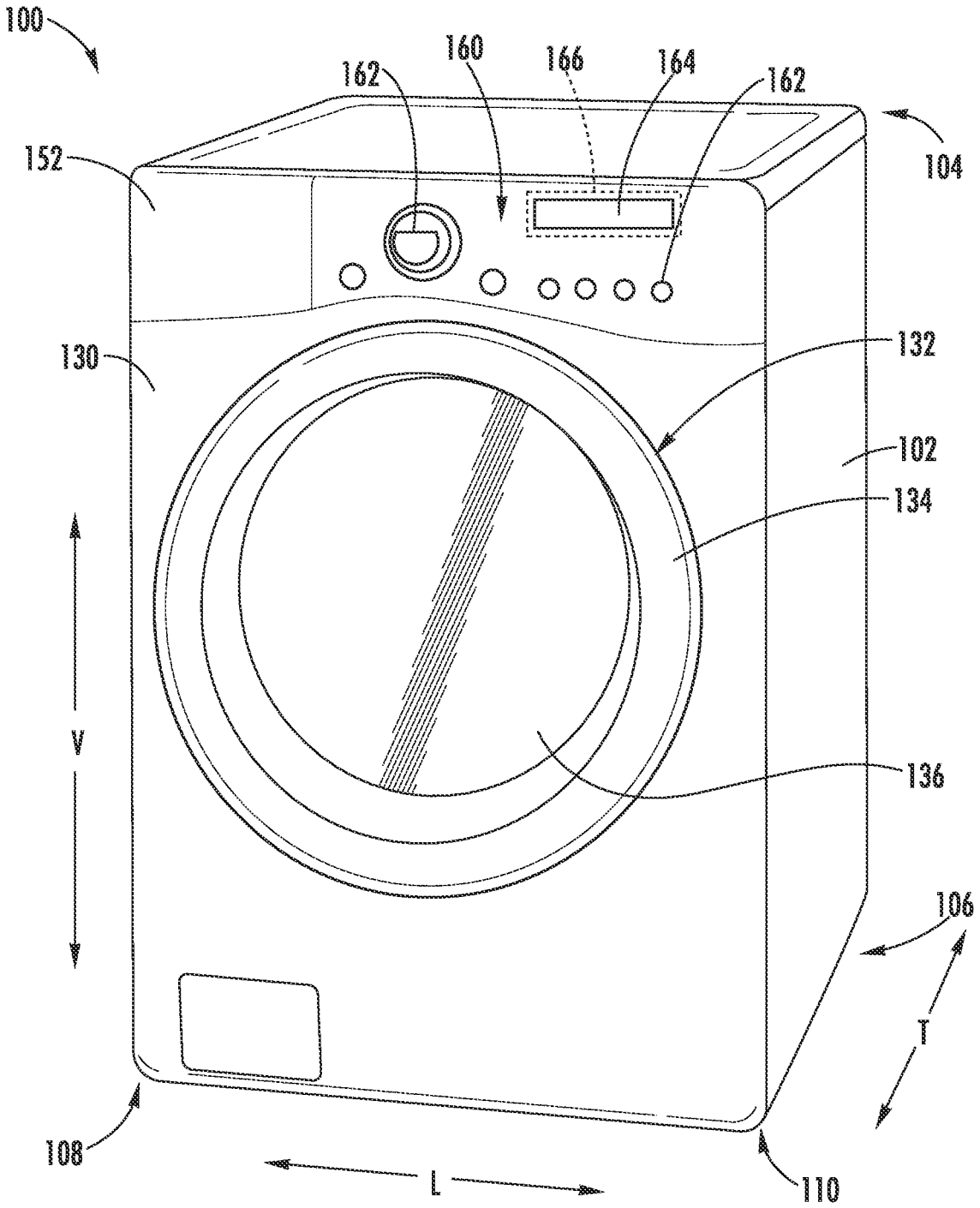
FIG. 1 provides a perspective view of a laundry appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one element from another and are not intended to signify location or importance of the individual elements.

Figure 2:
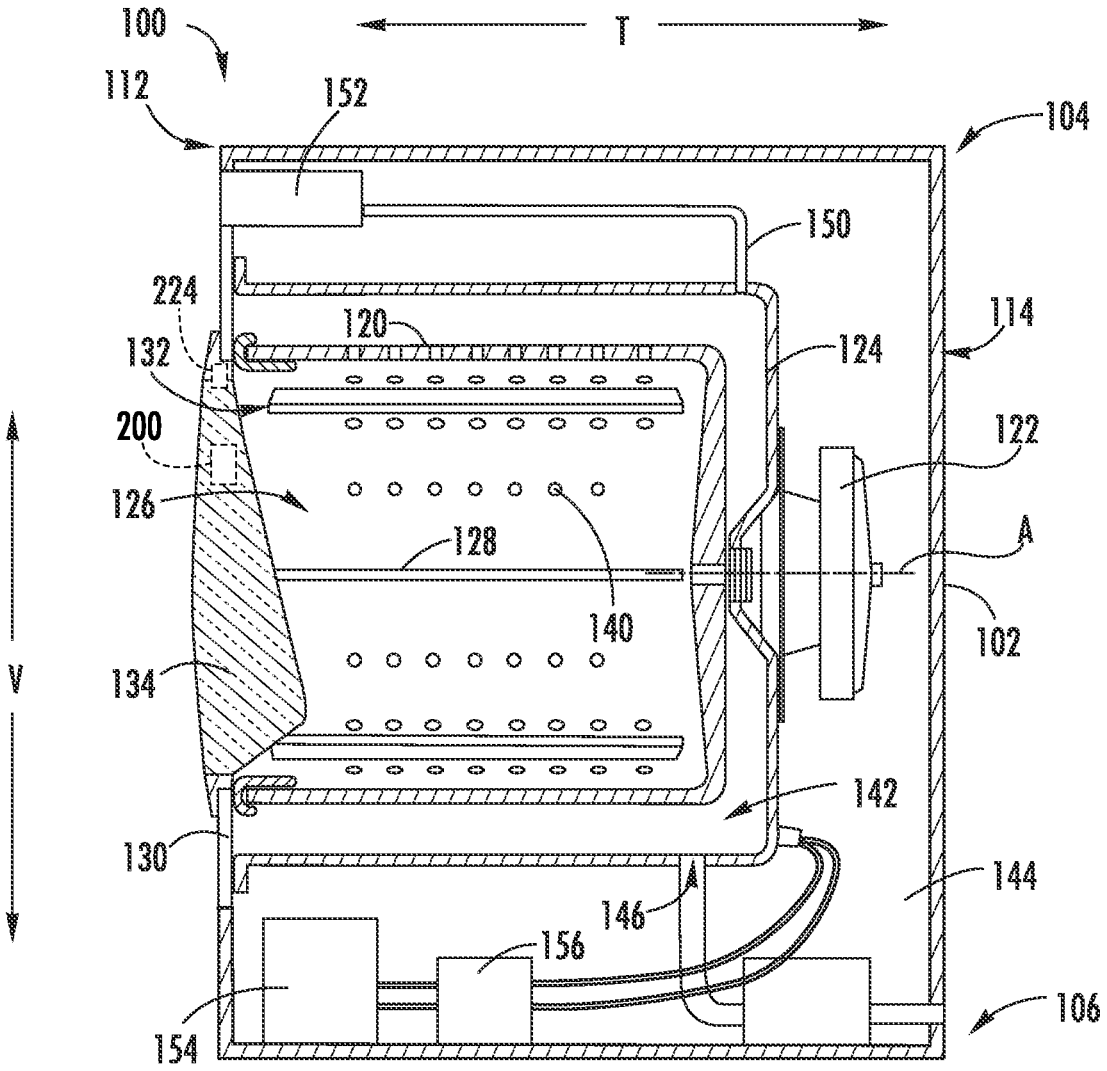
FIG. 2 provides a cross-sectional side view of the exemplary laundry appliance of FIG. 1.
Figure 3:
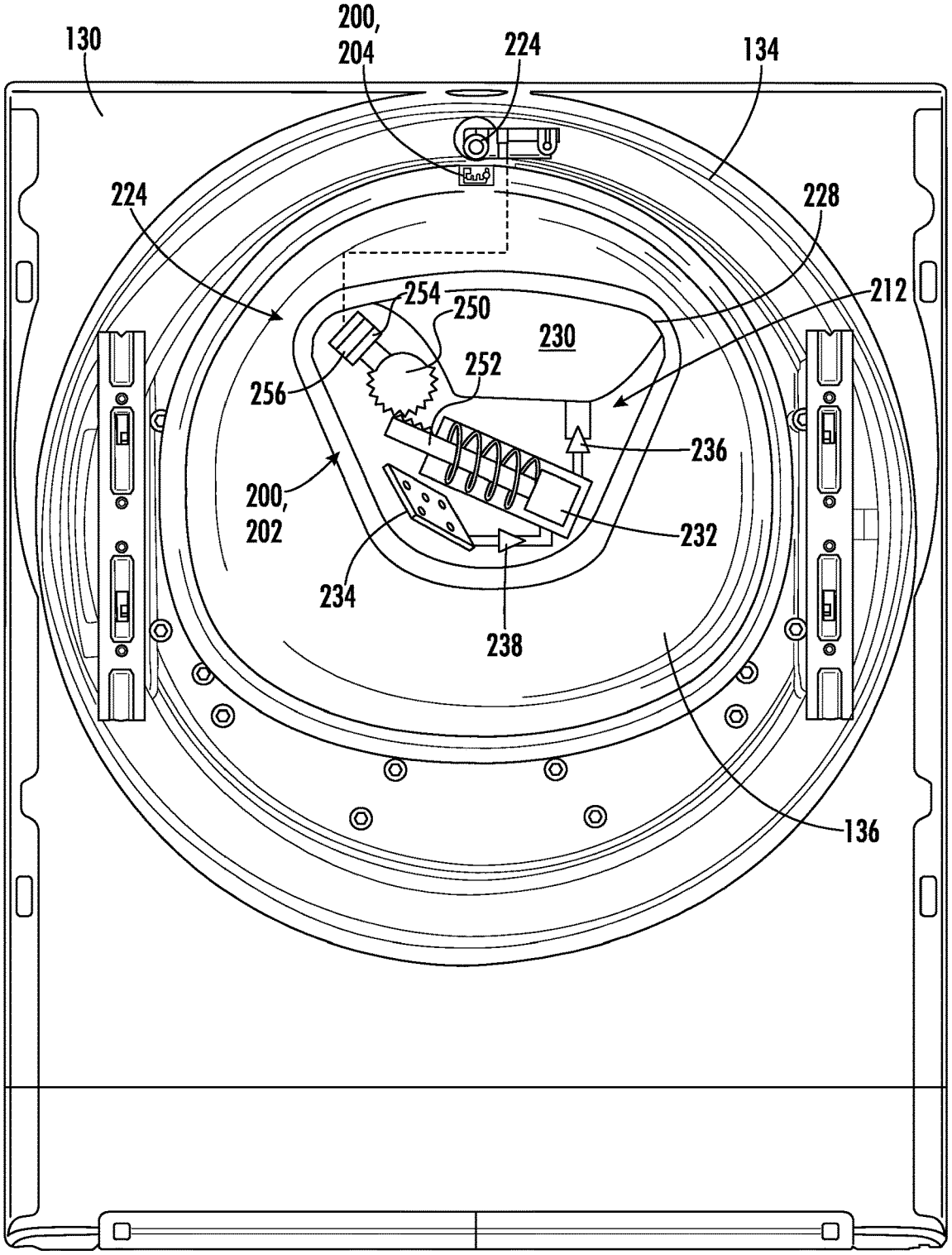
FIG. 3 provides an interior elevation view of the door and cabinet of the exemplary laundry appliance of FIG. 1.
Figure 3:
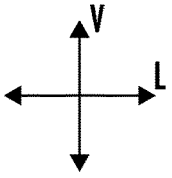
Figure 4:
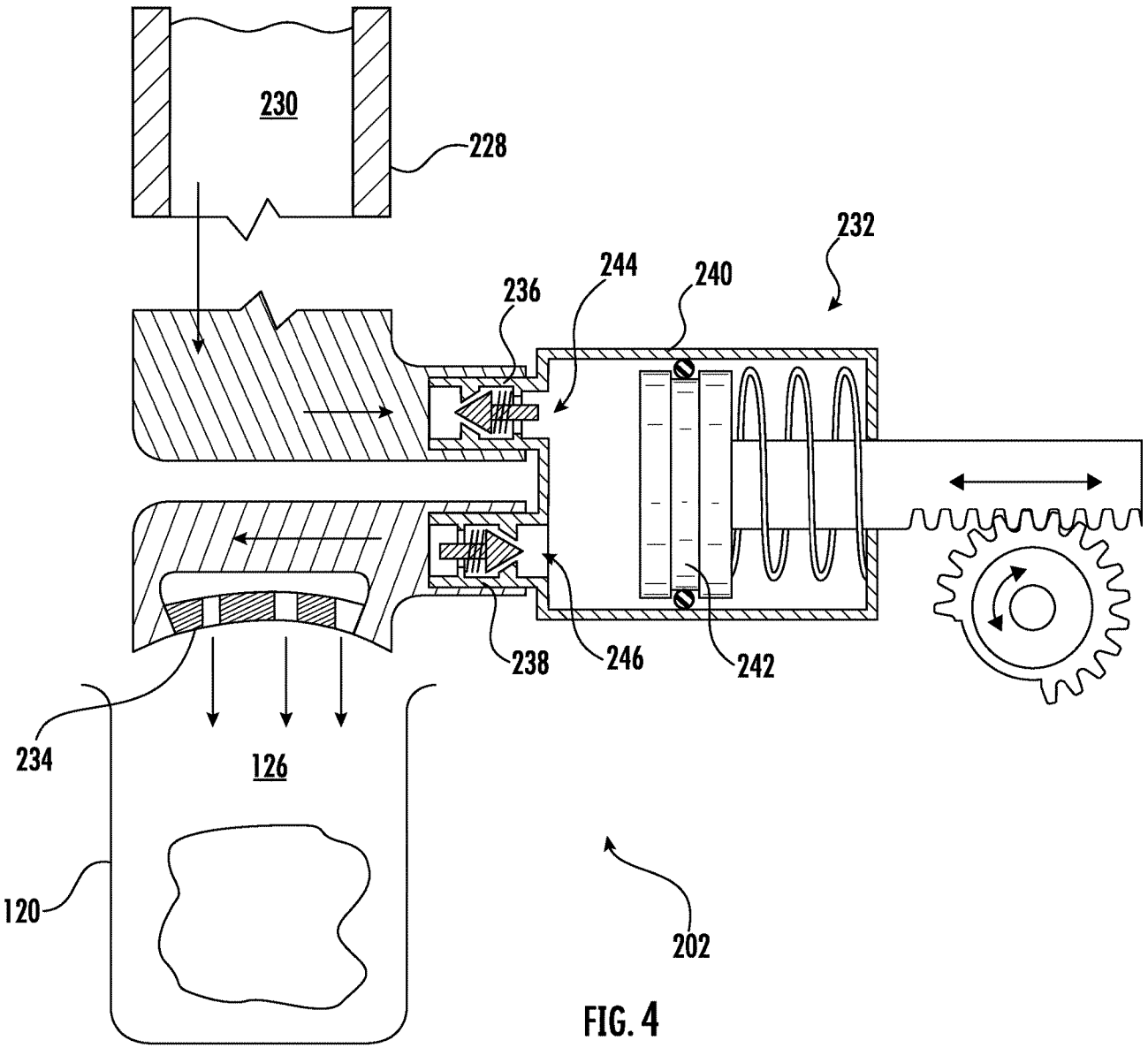
FIG. 4 provides a schematic view of the additive dispensing assembly of the exemplary door of FIG. 3.
Figure 5:
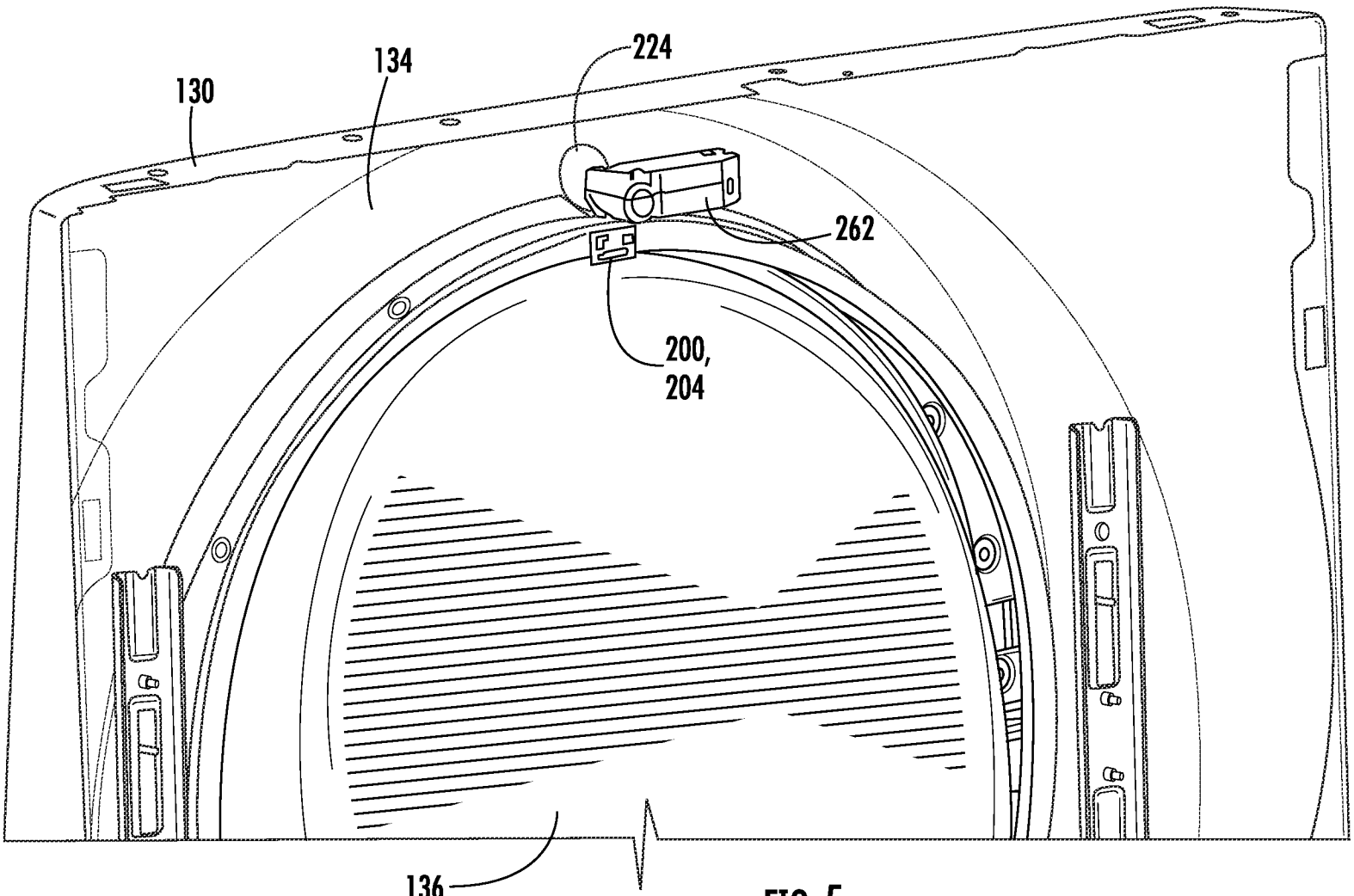
FIG. 5 provides an interior perspective view of the exemplary door of FIG. 3.
Figure 6:
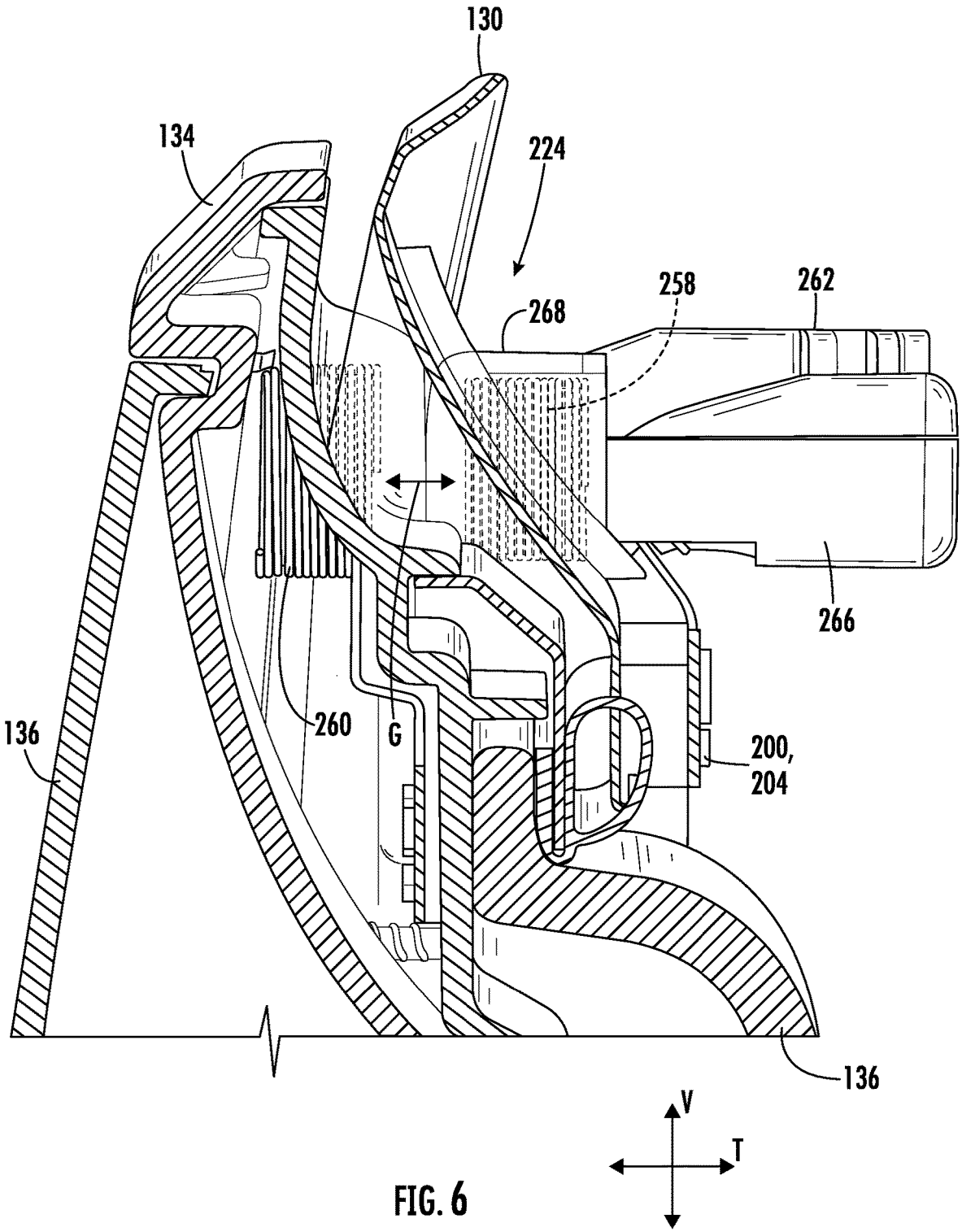
FIG. 6 provides a section view of a wireless power assembly, wherein the door is in a closed position, according to exemplary embodiments of the present disclosure.
Figure 7:
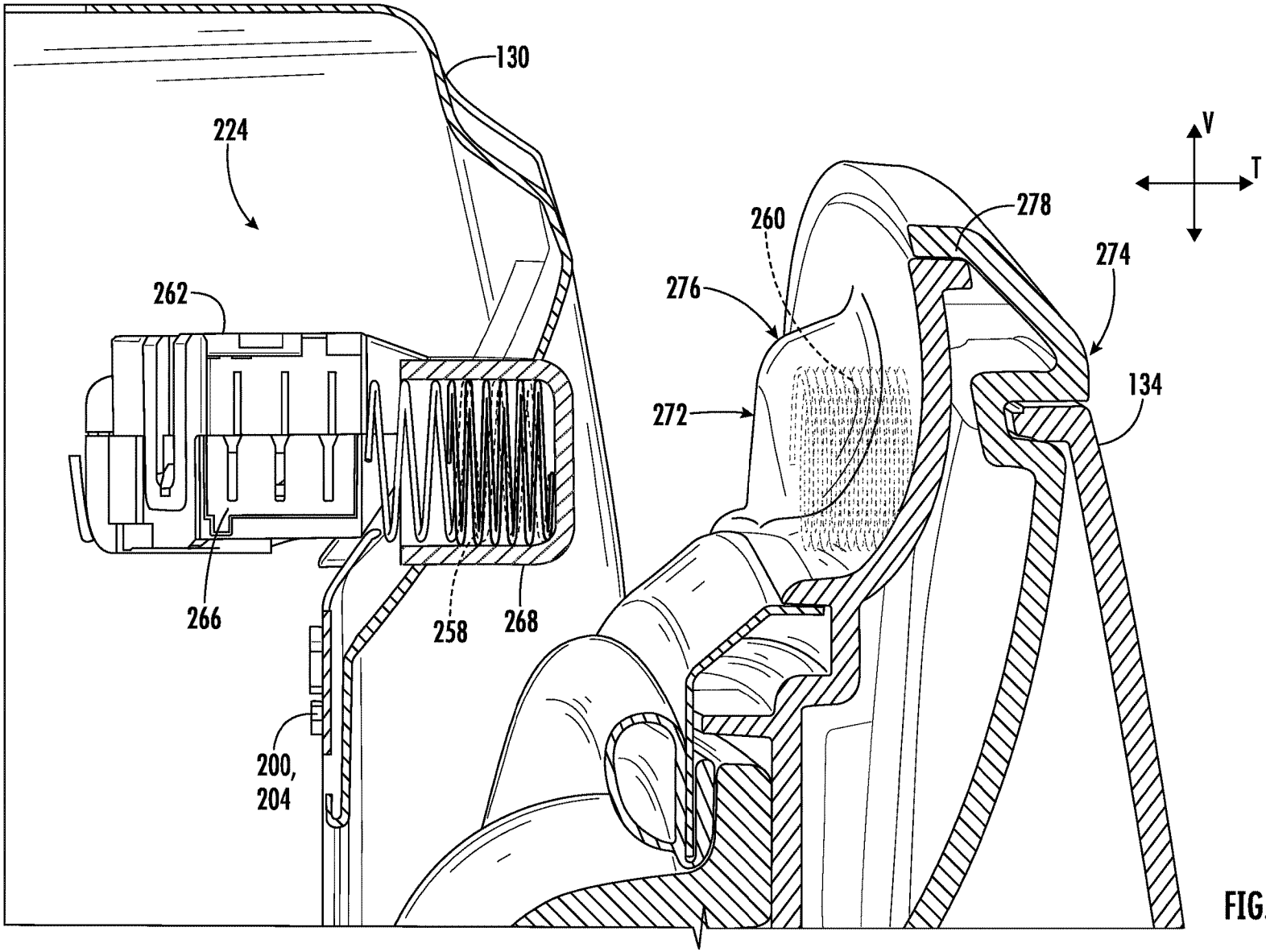
FIG. 7 provides a section view of a wireless power assembly, wherein the door is out of the closed position, according to exemplary embodiments of the present disclosure.
Figure 8:
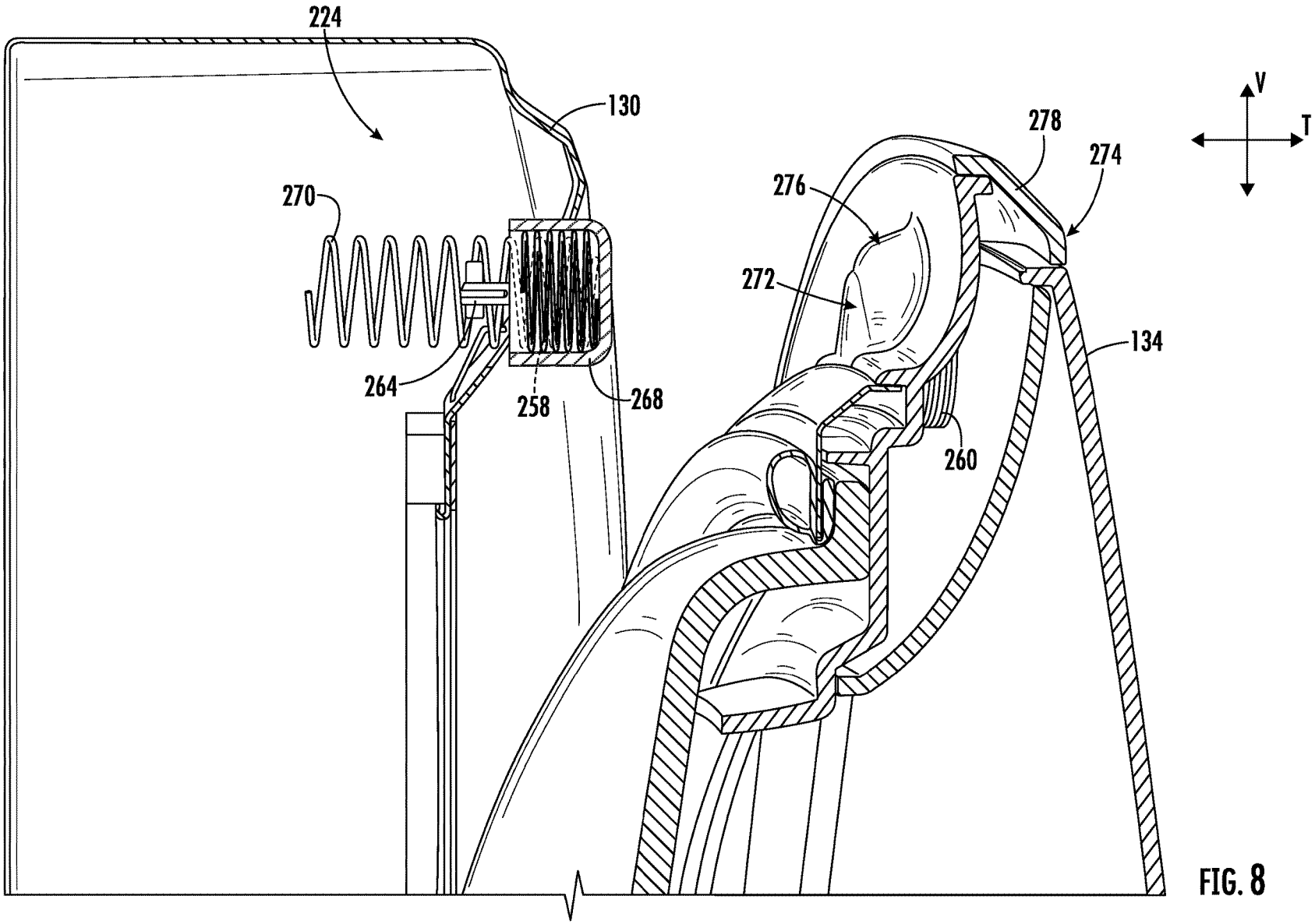
FIG. 8 provides a section view of a wireless power assembly, wherein the door is out of the closed position and a portion, according to exemplary embodiments of the present disclosure.
Figure 9:
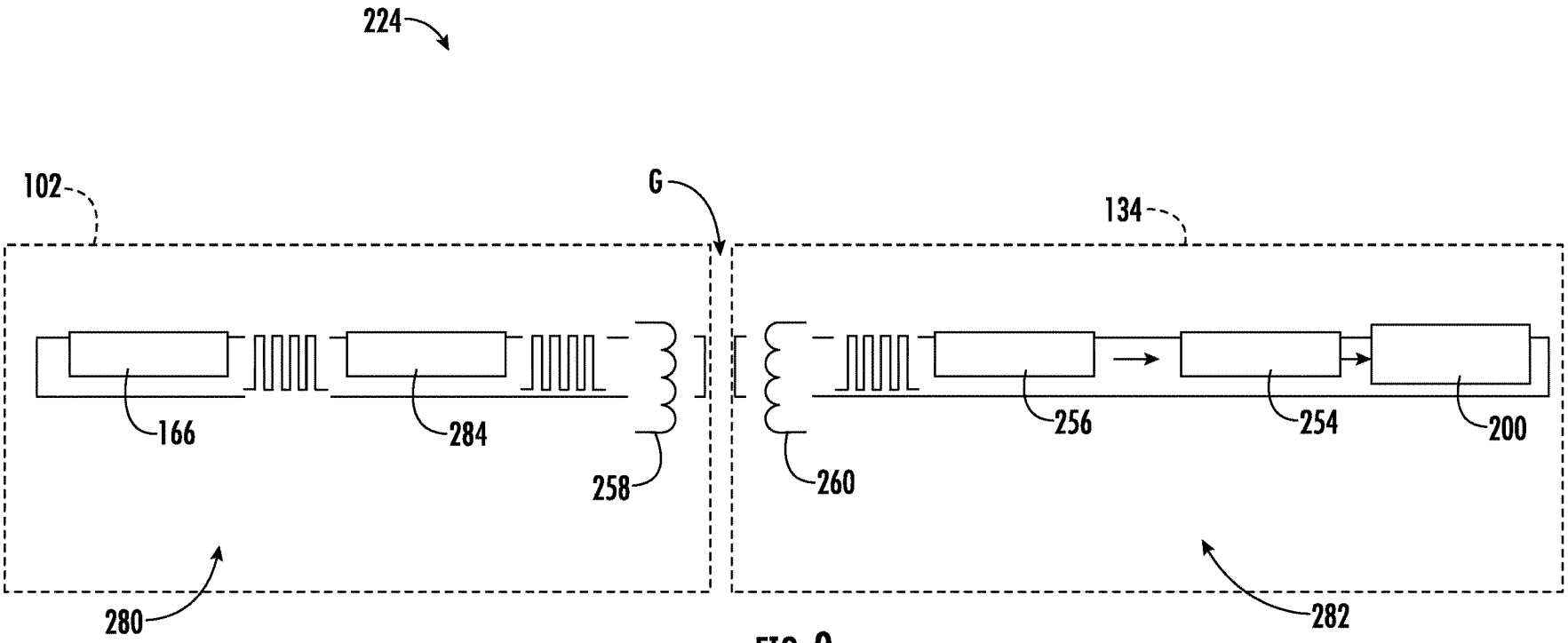
FIG. 9 provides a schematic view of an additive dispensing assembly according to exemplary embodiments of the present disclosure.

Referring now to the figures, FIG. 1 is a perspective view of an exemplary laundry appliance (e.g., horizontal axis washing machine appliance 100) and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

It is noted that although the horizontal axis washing machine appliance 100 is illustrated as an exemplary laundry appliance, the present disclosure is not limited to such an appliance. As would be understood, the teachings of the present disclosure would be applicable to and encompass other laundry appliances, such as a dryer appliance, or other configurations of a washing machine appliance, such as a vertical axis washing machine appliance. Thus, except as otherwise limited by the claims, washing machine appliance 100 is merely an illustrative non-limiting example of a laundry appliance that includes features of the present disclosure.

In some embodiments, a wash tub 124 is positioned within cabinet 102. Wash tub may be configured to retain or more fluids (e.g., wash fluids, such as water, detergent, fabric softener, bleach, or any other suitable wash additive or combination thereof). Wash tub 124 may be substantially fixed relative to cabinet 102 such that it does not rotate or translate relative to cabinet 102.

Generally, a drum (e.g., wash tub 124) is mounted within cabinet 102 and defines a space (e.g., wash chamber 126) to receive articles for treatment (e.g., washing or drying). In the illustrative example of FIGS. 1 and 2, wash basket 120 is received within wash tub 124 and defines a wash chamber 126 that is configured for receipt of articles for washing. More specifically, wash basket 120 is rotatably mounted within wash tub 124 such that it is rotatable about an axis of rotation A. According to the illustrated embodiment, the axis of rotation is substantially parallel to the transverse direction T. In this regard, washing machine appliance 100 is generally referred to as a "horizontal axis" or "front load" washing machine appliance 100. However, as noted above, it should be appreciated that aspects of the present subject matter may be used within the context of a vertical axis or top load washing machine appliance, as well as a suitable dryer appliance.

Wash basket 120 may define one or more agitator features that extend into wash chamber 126 to assist in agitation and cleaning articles disposed within wash chamber 126 during operation of washing machine appliance 100. For example, as illustrated in FIG. 2, each of a plurality of baffles or ribs 128 extends from basket 120 into wash chamber 126. In this manner, for example, ribs 128 may lift articles disposed in wash basket 120 during rotation of wash basket 120.

Washing machine appliance 100 includes a motor assembly 122 that is in mechanical communication with wash basket 120 to selectively rotate wash basket 120 (e.g., during an agitation or a rinse cycle of washing machine appliance 100). According to the illustrated embodiment, motor assembly 122 is a pancake motor. However, it should be appreciated that any suitable type, size, or configuration of motor may be used to rotate wash basket 120 according to alternative embodiments. Motor assembly will be described in further detail below.

In some embodiments, cabinet 102 also includes a front panel 130 that defines an opening 132 that permits user access to wash basket 120 of wash tub 124. More specifically, washing machine appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to a wash tub 124 and a closed position (FIG. 1) prohibiting access to wash tub 124. As will be explained in further detail below, door 134 may support one or more electronic features 200 mounted thereon.

In optional embodiments, a window 136 in door 134 permits viewing of wash basket 120 when door 134 is in the closed position (e.g., during operation of washing machine appliance 100). Door 134 also includes a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments. Additionally or alternatively, a front gasket or baffle 138 may extend between tub 124 and the front panel 130 about the opening 132 covered by door 134, further sealing tub 124 from cabinet 102.

In exemplary embodiments, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of, and generally collects, wash fluid during operation of washing machine appliance 100. For example, during operation of washing machine appliance 100, wash fluid may be urged (e.g., by gravity) from basket 120 to sump 142 through plurality of perforations 140. A pump assembly 144 is located beneath wash tub 124 for gravity assisted flow when draining wash tub 124 (e.g., via a drain 146). Pump assembly 144 is also configured for recirculating wash fluid within wash tub 124.

In additional or alternative embodiments, washing machine appliance 100 includes an additive dispenser or spout 150. For example, spout 150 may be in fluid communication with a water supply (not shown) in order to direct fluid (e.g., clean water) into wash tub 120. Spout 150 may also be in fluid communication with the sump 142. For example, pump assembly 144 may direct wash fluid disposed in sump 142 to spout 150 in order to circulate wash fluid in wash tub 120.

As illustrated, a detergent drawer 152 may be slidably mounted within front panel 130. Detergent drawer 152 receives a wash additive (e.g., detergent, fabric softener, bleach, or any other suitable liquid or powder) and directs the fluid additive to wash chamber 126 during operation of washing machine appliance 100. According to the illustrated embodiment, detergent drawer 152 may also be fluidly coupled to spout 150 to facilitate the complete and accurate dispensing of wash additive.

In optional embodiments, a bulk reservoir 154 is disposed within cabinet 102. Bulk reservoir 154 may be configured for receipt of fluid additive for use during operation of washing machine appliance 100. Moreover, bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to wash tub 124.

A control panel 160 including a plurality of input selectors 162 may be coupled to front panel 130. Control panel 160 and input selectors 162 collectively form a user interface input for operator selection of machine cycles and features. For example, in one embodiment, a display 164 indicates selected features, a countdown timer, or other items of interest to machine users.

Operation of washing machine appliance 100 may be generally controlled by a controller or processing device 166 that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive memory) and microprocessor, such as a general or special purpose microprocessor operable to execute programming instructions or micro-control code associated with a wash operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100, such as motor assembly 122, may be in communication with controller 166 via one or more signal lines or shared communication busses.

Turning now generally to FIGS. 2 through 9, some embodiments may include one or more electronic features 200 that are electrically isolated from controller 166, yet configured to activate on or within appliance 100. Any suitable electronic feature 200 may be provided, such as to provide light, one or more additives, etc. to a portion of appliance 100. Generally, such electronic features 200 receive power through a wireless power assembly 224, as will be described in detail below. For instance, wireless power assembly 224 may be in operable communication (e.g., electrical communication) with controller 166. In turn, controller 166 may selectively direct a voltage or signal to electronic feature(s) 200 through wireless power assembly.

In certain embodiments, the electronic feature(s) 200 include an additive dispensing assembly 202. For instance, at least a portion of additive dispensing assembly 202 may be mounted on door 134 (e.g., within an internal cavity 212 defined by window 136). Generally, additive dispensing assembly 202 may include an additive tank 228, fluid pump 232, or dispenser nozzle 234 (e.g., in fluid communication with each other to selectively dispense an additive mist to wash chamber 126).

In some embodiments, one or more portions of additive dispensing assembly 202 (e.g., additive tank 228 or fluid pump 232) are secured within internal cavity 212 via a plurality of mounting features or mechanical fasteners. Additionally or alternatively, adhesive(s), snap-fit mechanisms, interference-fit mechanisms, or any suitable combination thereof may secure one or more portions of additive dispensing assembly 202 to door 134. One skilled in the art will appreciate that additive dispensing assembly 202 may be mounted to door 134 using other mounting means according to alternative embodiments.

Generally, additive tank 228 is mounted upstream from a dispenser nozzle 234 to retain a liquid additive (e.g., laundry additive) that may be dispensed to wash chamber 126 through dispenser nozzle 234. Thus, one or more suitable fluid conduits or pipes may extend from additive tank 228 to dispenser nozzle 234. In certain embodiments, additive tank 228 defines a tank volume 230 within internal cavity 212, and within which a laundry additive may be poured. For instance, tank volume 230 may be provided as an isolated (e.g., non-plumbed) volume. Thus, a user may directly supply an additive (e.g., liquid laundry additive) to tank volume 230, which may then be used during operation of the respective appliance 100. Moreover, a user may directly refill the laundry additive by opening the door 134, opening the internal cavity 212 (e.g., by lifting a covering lid or flap—not pictured), and accessing or removing additive tank 228 from internal cavity 212.

Generally, tank volume 230 may be sized to store sufficient amounts of laundry additives for multiple cycles in order to avoid requiring the user to add a measured quantity of laundry additive prior to each dryer cycle. Optionally, the laundry additive may include a cleaning fluid (e.g., detergent, bleach, peroxide-based cleaner, etc.). Additionally or alternatively, the laundry additive may include a UV fabric protector (e.g., a fluid comprising titanium oxide, bemotrizinol, etc.) to absorb or repel ultraviolet light emissions. Also additionally or alternatively, the laundry additive may include a wrinkle release fluid (e.g., a fluid comprising fabric relaxer, fabric softener, isopropyl alcohol, vinegar, etc.) to reduce or prevent wrinkles from forming on articles within a load. Further additionally or alternatively, the laundry additive may include a medicinal liquid (e.g., antibacterial liquid, antiallergen, dermatitis-treatment liquid, burn-treatment liquid, insect repellant, topical cannabinoid, etc.). Still further additionally or alternatively, perfume material to provide a desirable smell or scent to a load. Moreover, it is noted that any other suitable laundry additive may be included.

As shown, a fluid pump 232 is in fluid communication with additive tank 228. For instance, one or more suitable fluid conduits or pipes may extend from additive tank 228 to fluid pump 232 or, alternatively, from fluid pump 232 to additive tank 228.

In exemplary embodiments, fluid pump 232 is downstream from additive tank 228 to selectively motivate a volume (e.g., predetermined volume) of laundry additive from additive tank 228. In some such embodiments, a check valve or one-way valve (e.g., first one-way valve 236) is mounted in fluid communication between additive tank 228 and fluid pump 232. In other words, a first one-way valve 236 may be disposed along the fluid path or conduit extending from additive tank 228 to fluid pump 232. First one-way valve 236 may thus ensure a unidirectional flow of laundry additive downstream from additive tank 228 (e.g., according to gravity or negative pressure generated at fluid pump 232).

Generally, fluid pump 232 may be provided as any suitable powered pump (i.e., not manually operated) to selectively force or motivate liquid or laundry additive from additive tank 228 to dispenser nozzle 234. In exemplary embodiments, fluid pump 232 includes a reciprocating pump assembly. For instance, fluid pump 232 may include a fluid cylinder 240 and a reciprocating piston 242 slidably disposed within cylinder 240. As shown, cylinder 240 may define a separate cylinder inlet 244 and cylinder outlet 246 through which liquid or laundry additive can enter and exit cylinder 240, respectively (e.g., according to the position of reciprocating piston 242 within cylinder 240). A pump motor 248 may be connected to or in mechanical communication with reciprocating piston 242 to control the position or movement of reciprocating piston 242 relative to cylinder 240. As an example, pump motor 248 may include a pinion gear 250 in mechanical communication with a rack gear provided on the piston rod 252 of reciprocating piston 242.

In some embodiments, fluid pump 232 is powered (e.g., selectively) by a wireless power assembly 224. Specifically, wireless power assembly 224 may be in operable communication (e.g., electrical communication) with controller 166. In turn, controller 166 may selectively direct a voltage or signal to fluid pump 232 through wireless power assembly 224, as will be described in greater detail below.

Downstream from the fluid pump 232 and additive tank 228, dispenser nozzle 234 is mounted. Generally, dispenser nozzle 234 defines one or more output apertures for additive dispensing assembly 202 and is directed toward the wash chamber 126 to guide or dispense a volume of the laundry additive into the space (i.e., chamber 126) defined by the tub 124 or wash basket 120. In some embodiments, dispenser nozzle 234 is mounted proximal to or on an interior surface of door 134. For instance, dispenser nozzle 234 may be mounted to an interior assembly panel formed on (or as part of) window 136. In some such embodiments, one or more holes are defined through the interior assembly panel to permit the spray of liquid or laundry additive into the space defined by tub 124 or wash basket 120. Optionally, dispenser nozzle 234 may include or be provided as an atomizer nozzle. Fluid flowing through additive dispensing assembly 202 from additive tank 228 may thus be directed into wash chamber 126 as an atomized misted flow of liquid or laundry additive.

In some embodiments, a check valve or one-way valve (e.g., second one-way valve 238) is mounted in fluid communication between fluid pump 232 and dispenser nozzle 234. In other words, a second one-way valve 238 may be disposed along the fluid path or conduit extending from fluid pump 232 to dispenser nozzle 234. Second one-way valve 238 may thus ensure a unidirectional flow of laundry additive from the fluid path downstream from fluid pump 232 (e.g., according to gravity or negative pressure generated at fluid pump 232).

Separate from or in addition to additive dispensing assembly 202, the electronic feature(s) 200 may include one or more light sources 204. In some such embodiments, a light source 204 may be generally directed at wash chamber 126. For instance, a light source 204 may be mounted proximal to or on an interior surface of door 134. For instance, light source 204 may be mounted to an interior assembly panel formed on (or as part of) window 136. When door 134 is in the closed position, light source 204 may be aimed at wash chamber 126 to project light emissions thereto. Such light emissions may be visible emissions (i.e., having a visible light wavelength) or ultraviolet (UV) light emissions (i.e., having a UV wavelength). In the case of UV light emissions, light source 204 may be configured as a UV sanitizing light, which may capable of destroying bacteria or viruses within the wash chamber 126 as would be understood.

In some embodiments, wireless power assembly 224 includes a pair of separate power coils 258, 260. Specifically, a physically separated transmitter power coil 258 and receiver coil may be provided on discrete portions of appliance 10. When assembled, transmitter power coil 258 and receiver power coil 260 may thus be wirelessly coupled without ever coming into direct or electrical contact. In particular, a gap G may be maintained between the two (e.g., along the transverse direction T). Instead, air or a non-conductive solid may hold power coils 258, 260, apart even when door 134 is the closed position In exemplary embodiments, transmitter power coil 258 is mounted on cabinet 102, apart from door 134. For instance, transmitter power coil 258 may be mounted to cabinet 102 proximal to door 134 (e.g., when door 134 is in the closed position). In some such embodiments, transmitter power coil 258 is mounted to the front panel 130, as shown. Within cabinet 102, transmitter power coil 258 may be electrically coupled to controller 166 (e.g., via an amplifying circuit 284 as part of a supply-side circuit 280).

In optional embodiments, transmitter power coil 258 is included with a discrete door switch 262. For instance, the door switch 262 may be mounted to cabinet 102 at the same or overlapping location with transmitter power coil 258. Generally, door switch 262 is configured to detect door 134 in the closed position, as would be understood. In some such embodiments, door switch 262 includes a plunger 264 (e.g., coaxial with transmitter power coil 258) extending toward door 134 (e.g., to selectively contact an inner surface 272 thereof). Plunger 264 may, for instance, slide along the transverse direction T to selectively engage a rearward switch body 266 when door 134 is in the closed position. A transmitter cap 268 may be disposed over plunger 264 or transmitter power coil 258. Optionally, a cap spring 270 may be in direct or indirect contact with transmitter cap 268 and bias transmitter cap 268 forward or otherwise towards door 134 (e.g., with transmitter power coil 258 or plunger 264). For instance, cap spring 270 may be coaxial or concentric with transmitter power coil 258 to bias transmitter power coil 258 forward with transmitter cap 268. When door 134 is moved away from the closed position (e.g., to an open position), cap spring 270 may motivate or push transmitter power coil 258, plunger 264, or transmitter cap 268 outward or forward (e.g., along the transverse direction T) to engage an interior or inner surface 272 of door 134 as it is returned to the closed position.

In certain embodiments, receiver power coil 260 is mounted to door 134. For instance, receiver power coil 260 may be mounted proximal to or within internal cavity 212 or another suitable region within door 134. As shown, receiver power coil 260 may be mounted between an inner surface 272 and outer surface 274 of door 134. Optionally, a coil emboss 276 housing receiver power coil 260 may be defined within a rim 278 of door 134 (e.g., to contact transmitter cap 268 when door 134 is in the closed position). When assembled, receiver power coil 260 is in electrical communication with fluid pump 232.

In some embodiments, wireless power assembly 224 includes a one or more control circuits on door 134 that are electrically coupled to receiver power coil 260. As illustrated, for instance, in FIG. 9, a rectifying circuit 256 or activation circuit 254 may be mounted to door 134 in electrical communication with electronic feature(s) 200 (e.g., light source 204 or pump motor 248) to supply power thereto (e.g., as a receiver-side circuit 282). Rectifying circuit 256, activation circuit 254, or pump motor 248 may be physically decoupled or isolated from controller 166 and, thus, share no physical connection with controller 166. Nonetheless, the receiver-side circuit 282 (e.g., rectifying circuit 256, or activation circuit 254, or pump motor 248) may be in wireless-power communication with a separate power supply or circuit on cabinet 102, such as a supply-side circuit 280 (e.g., including controller 166 or an amplifying circuit 284, which may be electrically coupled to controller 166).

Generally, transmitter power coil 258 and receiver power coil 260 may be configured to exchange an electromagnetic field which generates an electrical current. For instance, transmitter power coil 258 may transmit an electromagnetic field (e.g., as initiated by controller 166) that is received at receiver power coil 260. At receiver power coil 260, an electrical current or voltage may be generated and, subsequently transmitted through rectifying circuit 256 or activation circuit 254 to pump motor 248. For instance, the electromagnetic field may induce an electrical current at receiver power coil 260. Thus, the power coils 258, 260 may be a matched pair of resonant induction coils. Nonetheless, it is understood that any other suitable wireless power transmission method (e.g., inductive coupling, capacitive coupling, etc.) may be used.

In some embodiments, the power coils 258, 260 are configured such that the exchange of electromagnetic field is only permitted when door 134 is in the closed position. For instance, the distance or orientation of receiver power coil 260 relative to transmitter power coil 258 when door 134 is moved away from the closed position (e.g., in the open position) may prevent induction of a sufficient current or voltage at receiver power coil 260 to power electronic feature(s) 200. Thus, communication between transmitter power coil 258 and receiver power coil 260 is restricted in the open position of the door 134. Optionally, the electronic feature(s) 200 may be electrically isolated assemblies. In particular, receiver-side circuit 282 may be electrically isolated such that no electrical power storage (e.g., electrical battery or ultracapacitor) is provided thereon. Thus, in the absence of wireless communication with supply-side circuit 280, electronic feature(s) 200 may be free of a current or voltage therethrough, advantageously preventing unintended operation (e.g., when door 134 is in the open position).

In certain embodiments, controller 166 is configured to initiate a dispensing operation or otherwise control activation of electronic feature(s) 200 (e.g., at light source 204 or pump motor 248). For instance, controller 166 may direct a signal or voltage to transmitter power coil 258 in order to generate the electromagnetic field therefrom. In some such embodiments, activation of the electronic feature(s) 200 (e.g., light source 204 or pump motor 248) may be controlled entirely on the electrical current directed thereto. Thus, electronic feature(s) 200 may be communicatively isolated from controller 166. Notably, a complex transmission of data signals from controller 166 to the electronic feature(s) 200 may be avoided.

When door 134 is in the closed position, transmitter induction coil 258 may initiate an electromagnetic field to be transmitted therefrom. The transmitted electromagnetic field may then be received by the receiver induction coil 260 to generate a corresponding electrical current to be transmitted to one or more of the electronic feature(s) 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance comprising:
a cabinet;
a drum mounted within the cabinet, the drum defining a space for the receipt of articles therein;
a door movably mounted to the cabinet to selectively restrict access to the drum;
a transmitter power coil mounted to the cabinet proximal to the door;
a receiver power coil mounted to the door in selective electromagnetic communication with the transmitter power coil to receive an electromagnetic field therefrom;
an electronic feature in electrical communication with the receiver power coil to receive power therefrom;
a transmitter cap disposed over the transmitter power coil, the transmitter power coil being held within the transmitter cap; and
a cap spring biasing the transmitter cap towards the door.

2. The laundry appliance of claim 1, wherein the electronic feature comprises a fluid pump.

3. The laundry appliance of claim 1, wherein the electronic feature comprises a light source directed at the space for the receipt of articles.

4. The laundry appliance of claim 1, further comprising:
a door switch mounted to the cabinet at the transmitter power coil, the door switch being configured to detect the door in a closed position.

5. The laundry appliance of claim 1, wherein the cabinet comprises a front panel defining an opening selectively covered by the door, wherein the transmitter power coil is mounted to the front panel.

6. The laundry appliance of claim 1, wherein a transverse gap is defined between the transmitter power coil and the receiver power coil at a closed position of the door.

7. The laundry appliance of claim 1, further comprising:
a controller mounted on the cabinet in electrical communication with the transmitter power coil, the controller being configured to initiate a door-power operation comprising directing an electrical current to the transmitter power coil to power the electronic feature.

8. The laundry appliance of claim 1, wherein the electronic feature and the receiver power coil form part of an electrically isolated assembly on the door.

9. The laundry appliance of claim 1, wherein electromagnetic communication between the transmitter power coil and the receiver power coil is restricted in an open position of the door.

10. A laundry appliance comprising:

a cabinet;

a drum mounted within the cabinet, the drum defining a space for the receipt of clothes therein;

a door movably mounted to the cabinet to selectively restrict access to the drum in a closed position;

a transmitter power coil mounted to the cabinet proximal to the door;

a door switch mounted to the cabinet at the transmitter power coil;

a controller mounted to the cabinet in electrical communication with the transmitter power coil and the door switch to detect the door in the closed position;

a receiver power coil mounted to the door in selective electromagnetic communication with the transmitter power coil to receive an electromagnetic field therefrom; and an electronic feature in electrical communication with the receiver power coil to receive power therefrom, the electronic feature being electrically isolated from the controller;

a transmitter cap disposed over the transmitter power coil, the transmitter power coil being held within the transmitter cap; and a cap spring biasing the transmitter cap towards the door.

11. The laundry appliance of claim 10, wherein the electronic feature comprises a fluid pump.

12. The laundry appliance of claim 10, wherein the electronic feature comprises a light source directed at the space for the receipt of clothes.

13. The laundry appliance of claim 10, wherein the cabinet comprises a front panel defining an opening selectively covered by the door, wherein the transmitter power coil is mounted to the front panel.

14. The laundry appliance of claim 10, wherein a transverse gap is defined between the transmitter power coil and the receiver power coil at a closed position of the door.

15. The laundry appliance of claim 10, wherein the controller is configured to initiate a door-power operation comprising directing an electrical current to the transmitter power coil to power the electronic feature.

16. The laundry appliance of claim 10, wherein the electronic feature and the receiver power coil form part of an electrically isolated assembly on the door.

17. A laundry appliance comprising:

a cabinet;

a drum mounted within the cabinet, the drum defining a space for the receipt of clothes therein;

a door movably mounted to the cabinet to selectively restrict access to the drum in a closed position;

a transmitter power coil mounted to the cabinet proximal to the door;

a door switch mounted to the cabinet at the transmitter power coil;

a controller mounted to the cabinet in electrical communication with the transmitter power coil and the door switch to detect the door in the closed position;

an electrically isolated assembly mounted on the door, the electrically isolated assembly being electrically isolated from the controller and comprising a receiver power coil mounted to the door in selective electromagnetic communication with the transmitter power coil to receive an electromagnetic field therefrom, and a pump motor mounted to the door in electrical communication with the receiver power coil to receive power therefrom;

a transmitter cap disposed over the transmitter power coil, the transmitter power coil being held within the transmitter cap; and a cap spring biasing the transmitter cap towards the door, wherein a transverse gap is defined between the transmitter power coil and the receiver power coil at a closed position of the door.

18. The laundry appliance of claim 17, wherein the electrically isolated assembly further comprises a light source directed at the space for the receipt of clothes, the light source being mounted to the door in electrical communication with the receiver power coil to receive power therefrom, the light source being electrically isolated from the controller.

19. The laundry appliance of claim 17, wherein the cabinet comprises a front panel defining an opening selectively covered by the door, wherein the transmitter power coil is mounted to the front panel.

20. The laundry appliance of claim 17, wherein the controller is configured to initiate a door-power operation comprising directing an electrical current to the transmitter power coil to power the electrically isolated assembly.

* * * * *